United States Patent [19]

Meller et al.

[11] 4,008,936

[45] Feb. 22, 1977

[54] LD-3 CARGO CONTAINER

[75] Inventors: Oscar W. Meller; John W. Lovich, both of Akron, Ohio

[73] Assignee: Goodyear Aerospace Corporation, Akron, Ohio

[22] Filed: Jan. 23, 1975

[21] Appl. No.: 543,564

[52] U.S. Cl. ..... 312/352; 312/108; 160/207; 220/1.5; 105/376

[51] Int. Cl.[2] ..... A47B 87/00; E05D 15/26; B65D 87/00

[58] Field of Search ..... 312/352, 108, 258, 259; 220/255, 337, 340; 108/55, 5; 160/207; 211/176; 248/161

[56] References Cited

UNITED STATES PATENTS

| | | | |
|---|---|---|---|
| 1,209,360 | 12/1916 | Tomkinson | 160/207 |
| 1,610,036 | 12/1926 | Buxbaum | 160/207 |
| 1,757,048 | 5/1930 | Janeczko | 160/207 |
| 1,813,474 | 7/1931 | Ward | 160/207 |
| 2,155,116 | 4/1939 | Cox | 160/207 |
| 2,408,739 | 10/1946 | Dawes | 160/207 |
| 2,572,717 | 10/1951 | Gersten | 312/259 |
| 3,214,121 | 10/1965 | Armstrong | 248/161 |
| 3,221,919 | 12/1965 | Gessner | 220/337 |
| 3,598,273 | 8/1971 | Rau | 312/352 |
| 3,612,290 | 10/1971 | Evans | 211/176 |
| 3,645,596 | 2/1972 | Russell et al. | 312/108 |
| 3,658,114 | 4/1972 | Buehler | 160/207 |
| 3,807,574 | 4/1974 | Lanza | 211/176 |

FOREIGN PATENTS OR APPLICATIONS

| | | | |
|---|---|---|---|
| 1,421,583 | 11/1965 | France | 108/55 |
| 1,498,754 | 10/1967 | France | 108/55 |
| 940,525 | 12/1948 | France | 160/207 |

*Primary Examiner*—Paul R. Gilliam
*Assistant Examiner*—Victor N. Sakran
*Attorney, Agent, or Firm*—Oldham & Oldham Co.

[57] ABSTRACT

A cargo container is presented wherein entrance thereto is made by means of two low profile bifold doors comprising upper and lower door sections. The lower door section is foldable onto the upper door section by means of a continuous longitudinal hinge interconnecting the two while the top door section has therein a slide and track arrangement whereby the folded door assembly may be stored atop the container. An adjustable shelf is provided with pin latches securable by means of metallic springs which allow a single operator to securedly engage or disengage the various pins and subsequently maneuver the positioning of the shelf.

5 Claims, 10 Drawing Figures

LD-3 CARGO CONTAINER

BACKGROUND OF THE INVENTION

It has been known for many years to use cargo containers for storing and transporting baggage and the like. There have become known any of numerous types of cargo containers taking on various shapes, sizes, configurations, and structural characteristics. It has now become desirable that a cargo container be constructed wherein access to the interior of the container may be made by means of two low-profile doors storable atop the cargo container and wherein a shelf may be retained within the container itself and adjustable by a single operator. It has further become desirable that such a cargo container be constructed having a good structural integrity while being lightweight and inexpensive to construct and maintain.

The instant invention provides for the above-recited desirable objects by the presentation of a cargo container having a top, a base, two end panels interconnecting said top and base, and a header extending along the edge of the top and interconnecting the two end panels and further having the improvement, comprising an upper door section supportingly engaged at the top thereof by the header and having a channel member extending along the bottom edge thereof; a lower door section having an edge member extending along and obliquely protruding from the top thereof; and a longitudinal hinge interconnected between the channel member and edge member and extending therealong.

For a complete understanding of the objects and structure of the invention reference should be had to the following detailed description and accompanying drawings wherein.

Figure 1:
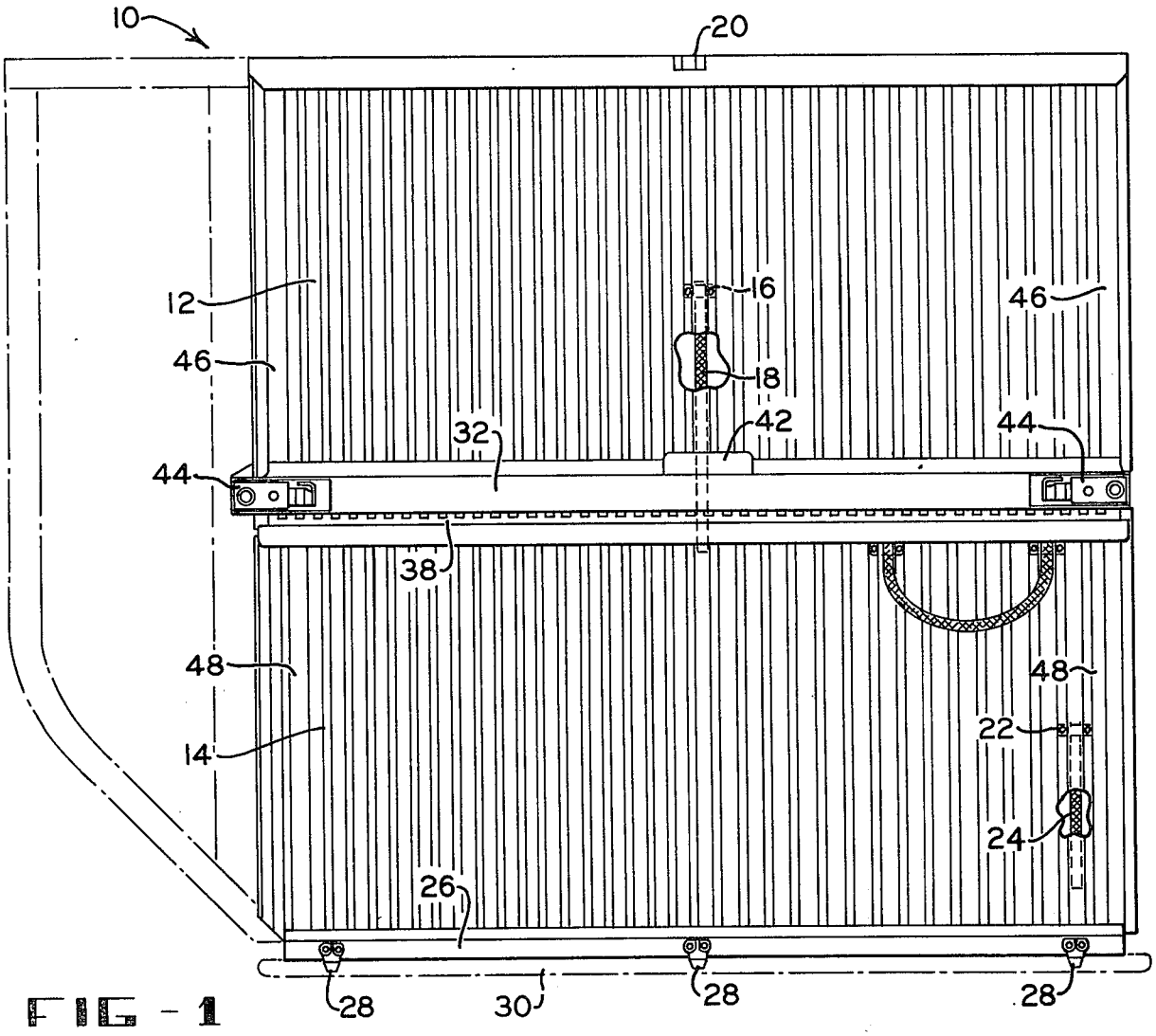
FIG. 1 is a front elevational view of the cargo container of the invention with the door attached thereto.

Referring now to the drawings and more particularly FIG. 1, it can be seen that the cargo container, shown in front plan view, is designated generally by the numeral 10. Enclosing the substantially rectangular portion of the container and providing means for making access to the interior thereof is a door comprising an upper door section 12 and lower door panel 14 both preferably of a corrugated aluminum construction. Connected to the upper section 12 is a bracket 16 making securing engagement with a strap 18. This strap

Figure 3:
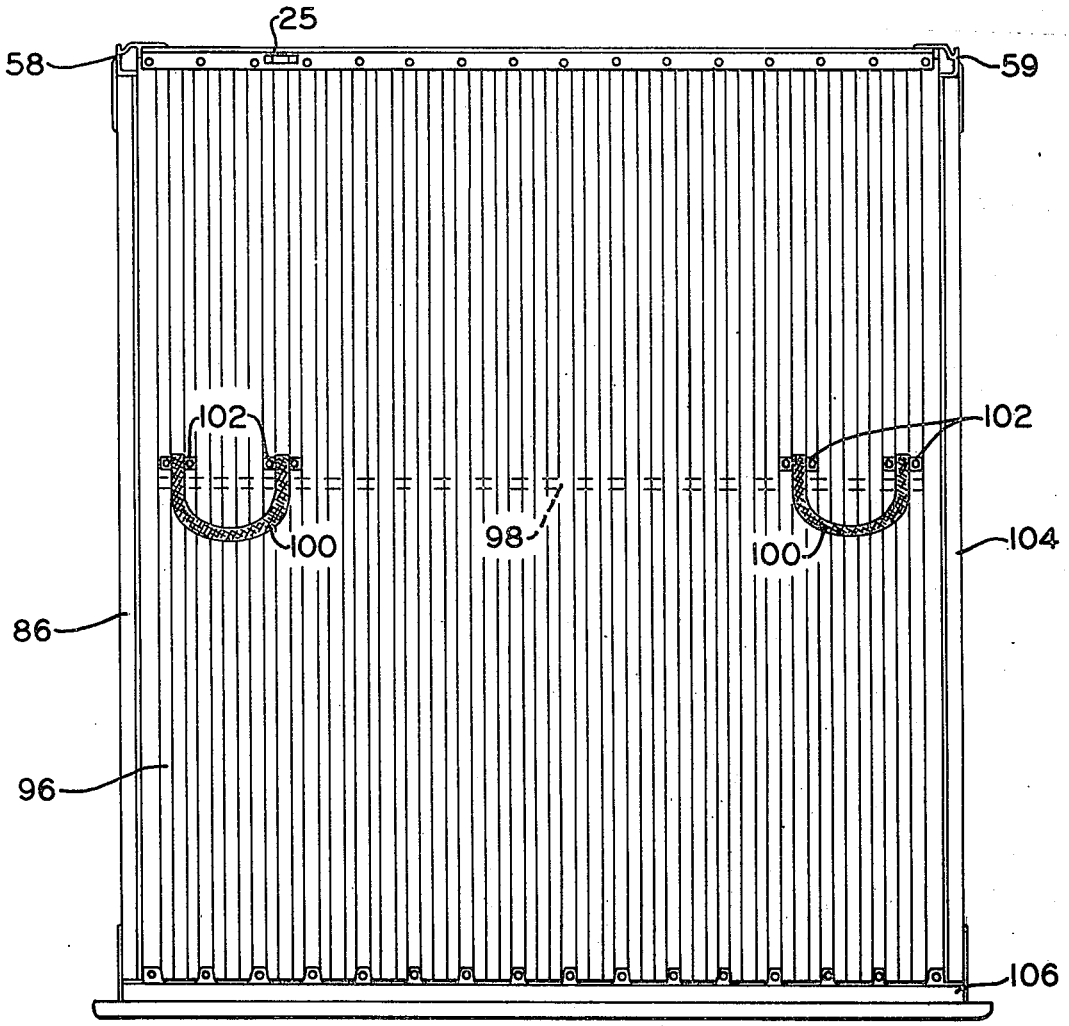
FIG. 3 is an end elevational view of the cargo container of the invention.

18, as will become apparent hereinafter, is used for making securing engagement with the spring catch 20 when the lower section 14 is folded onto the upper section 12 and stored atop the cargo container as will be discussed hereinafter. A further bracket 22 is affixed to the interior of the lower door panel 14 and secures a hold down strap 24 which is operative for making securing engagement with a hold down catch 25 to retain the door atop the container when so desired. Catch 25 is best shown in FIG. 3.

A base rail 26 is attached along the entire width of the lower door section 14 and has depending therefrom a plurality of shear pins 28 operative for engagement with recesses (not shown) within the extruded edge rail 30 of the base of the container. This type of door engagement with the base of the container is, of course, known in the art.

Figure 4:
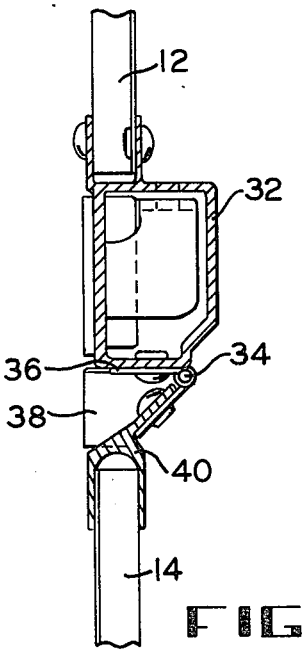
FIG. 4 is a cross-sectional view of the center bar and longitudinal hinge interconnecting the upper and lower door sections of the cargo container.

As shown in FIGS. 1 and 4, a horizontal channel 32 is attached to the lower edge of the upper door section 12 along the entire width thereof. The channel 32 is in turn connected to a longitudinal upper hinge element 36. An extruded angled edge element 40, substantially dog-legged in nature, is similarly affixed along the entire width of the lower door section 14. Attached to the dog-legged member is a lower longitudinal hinge element 38. Interconnecting the upper and lower hinge elements 36,38 is a pivotal pin 34, again extending the entire width of the door assembly. A handle 42 is connected to the channel 32 and facilitates the manipulation of the door assembly as will be discussed hereinafter. Latch assemblies 44 are present at each end of the channel 32 and are operative to make sliding engagement with latching studs (not shown) connected to vertical post members 74,86. Such slide latch assemblies are known in the art and therefore not elaborated on herein. Of course, each of the door assemblies 12,14 have appropriate extruded edge members 46,48 along the edges thereof to provide for making sealing engagement with the vertical post members 74,86 in normal fashion.

Figure 2:
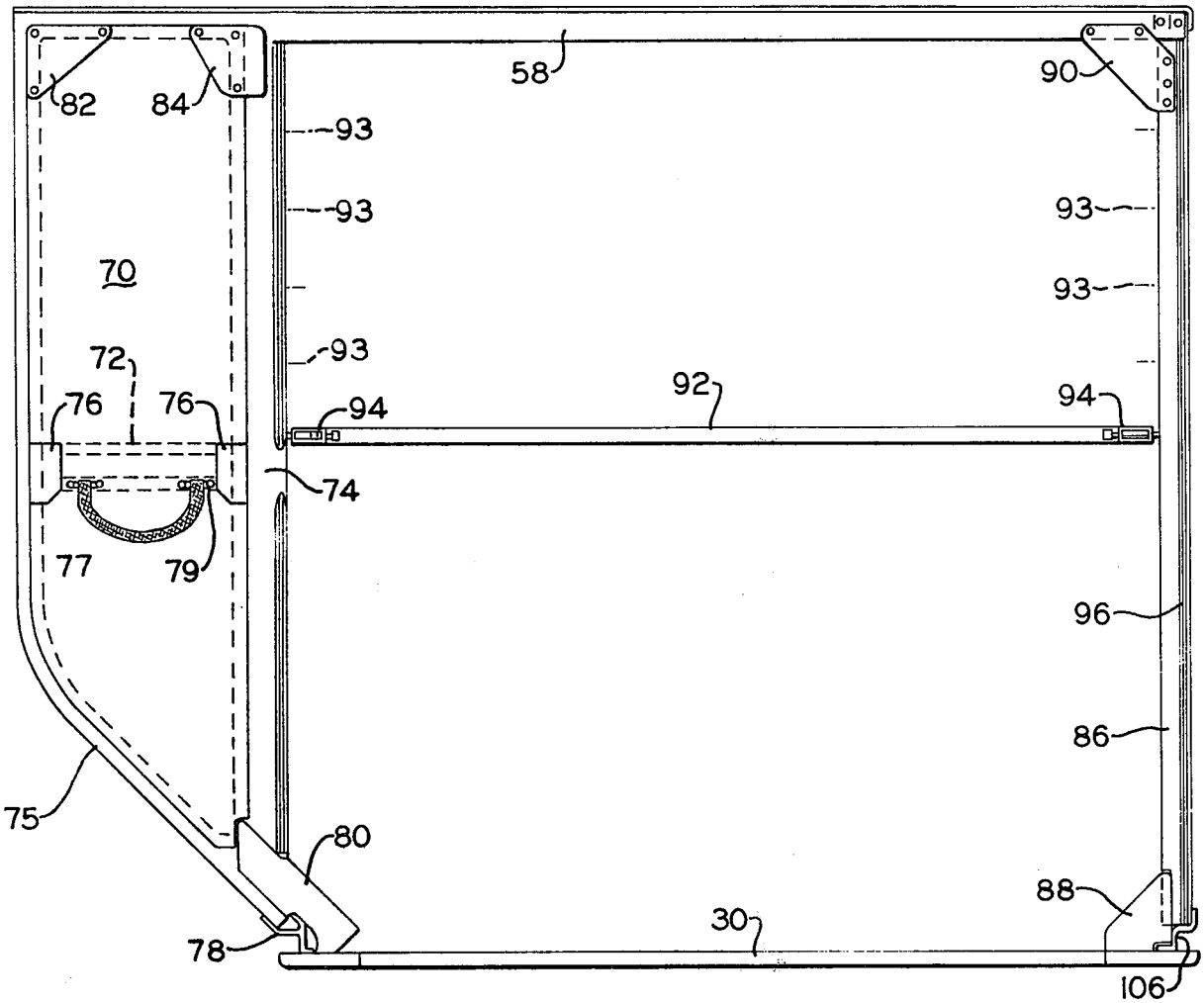
FIG. 2 is a front elevational view of the cargo container as shown in FIG. 1 with the door removed.

FIG. 2 shows the basic structure of the cargo container as shown in FIG. 1 with the bifold door 12,14 removed. Here it can be seen that a trapezoidal panel 70 fits over the trapezoidal end section overhanging the base of the container. The panel 70 may be of any suitable nature but is preferably of a thin aluminum sheet construction. A stiffner channel 72 is interconnected between gussets 76 so as to effectively interconnect the vertical post 74 and the trapezoidal end panel 75. A base rail 78 is interconnected between the base of the cargo container and the bottom of the trapezoidal end section, which is preferably corrugated, and runs the entire depth thereof. Further adding strength on both the fore and aft sides of the container are brackets 80 which serve to interconnect the base of the container with the vertical post 74, trapezoidal end section 75 and end panel 70. Gussets 82,84 connect the panel 70 to the header 58, vertical post 74 and trapezoidal end section 75. A strap 77 is connected by means of brackets 79 to the stiffner 72 to facilitate handling of the container.

At the flat end section of the cargo container, a vertical edge member 86 is connected to the corrugated end panel 96. Brackets 88,90 provide for securing engagement between the edge member 86 and the base of the cargo container and header 58. Positioned within the cargo container and adjustable by means of a plurality of holes spaced within the edge member 86 and the vertical post 74 is a shelf 92 which is preferably of an aluminum clad balsa construction. Adjustability of the shelf 92 with the slots 93 is provided for by means of the pin latch assemblies 94 to be discussed hereinafter.

FIG. 3 is an end view of the container of FIG. 2 shown without either the front or back bifold doors being attached thereto. A corrugated end panel 96 encloses this end of the cargo container and is reinforced across the end section thereof by means of a narrow tension strap 98 which may be of a metal construction. Affixed in close force-bearing positional relationship to the tension strap 98 are handling straps 100 secured to the corrugated panel 96 by means of brackets 102. A back vertical edge member 104 is provided for the same purpose as is the front edge member 86. Similarly, a header 59 is provided and is complementary with the front header 58. As it can be seen in this view, the base rail 106 is attached to the corrugated panel 96 to secure the same to the base. The corrugations at this connection provide sufficient air passageways to allow for rapid decompression of the cargo container 10 when the same is required.

Figure 6:
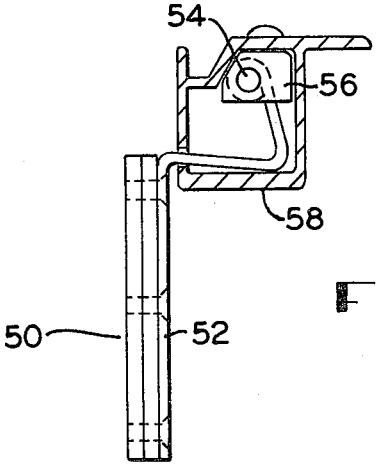
FIG. 6 is a cross-sectional view of the header and slide assembly used in association with the low profile door.
Figure 6A:
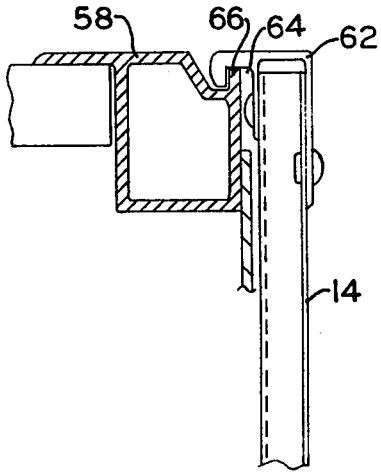
FIG. 6A is a cross-sectional view of a header and upper door section according to the invention.

The interconnection of the doors of the cargo container with their respective headers may be seen in FIGS. 6 and 6*a*. Referring first to FIG. 6*a*, it can be seen that the upper door section 12 has connected thereto an extruded edge element 62 being U-shaped at 64 to make interlocking engagement with a lip 66 of the header 58. Engagement between cargo container door assembly 12,14 is substantially achieved along the entire length of the headers 58,59 by means of weight supporting engagement between the lip 66 and U-shaped element 64.

Figure 5:
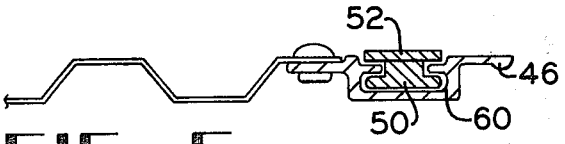
FIG. 5 is a cross-sectional view of an edge member of the upper door section showing the track therein.

There is provided at each end of the headers 58 and 59 a slide 50 fixedly secured to an angled hinge 52 pivotal at a pin 54 which is secured via a hinge block 56 to the appropriate header. As can now be seen in the cross-sectional view of FIG. 5, the slide and hinge assembly 50,52 is operative to be received in sliding engagement within a channel or track 60 which is extruded within the edge members 46 of the upper sections 12 of the two door assemblies. The slide 50 is preferably of a nylon construction while the edge member 46 is preferably of aluminum.

It should now be apparent that the combination of the slide and track assembly 50,60 and the longitudinal hinge assembly 34 – 38 provides the maneuverability necessary for the low-profile bifold door utilized with the container of the invention. By unlatching the latches 44 and pulling outward on the handle 42 the operator may buckle the door outward about the hinge pin 34 due to the slight clearance between the upper and lower hinge plates 36, 38 so as to release the shear blades 30 from their base slots. Once the pins 30 are so released, the lower door section 14 may then be folded about the pin 34 and onto the upper door section 12 into a closely adjacent relationship. With the two door panels folded together, the assembly may then be rotated about the hinge pins 54 within the respective headers 58,59 until the slide and track assemblies 50,60 are in parallel relationship with the top of the cargo container. At this time, horizontal pushing of the door assembly 12,14 will slide the assembly along the track 60 placing the door atop the cargo container. The doors will then protrude above the cargo container a distance slightly greater than twice the thickness of one of the door sections. Of course, the depth of the cargo container is such that both the front and back door may be simultaneously stored atop the container. With the door so stored, the hold down strap 24 may be securedly engaged with the bracket 25 to retain the door in its stowed position. Similarly, the strap 18 may be pulled over the folded door assembly and connected to the spring catch 20 prior to the storing atop the container so as to retain the upper and lower sections 12,14 in a single unitary relationship.

Figure 7A:
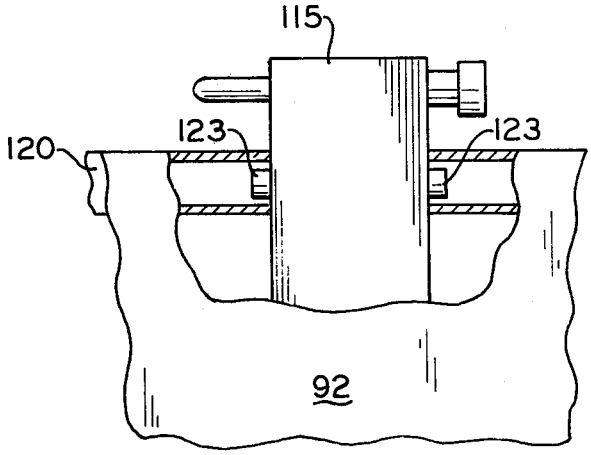
FIG. 7A is a top plan view of a pin assembly for the adjustable shelf of the container for engagement with the doorposts.
Figure 7:
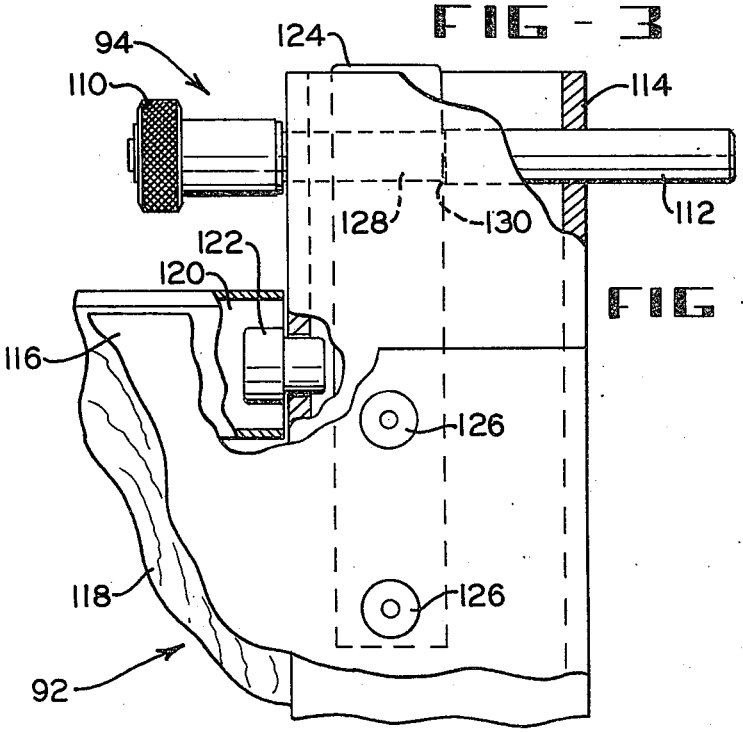
FIG. 7 is a cut-away view of the pin latch assembly associated with the adjustable shelf.
Figure 8:
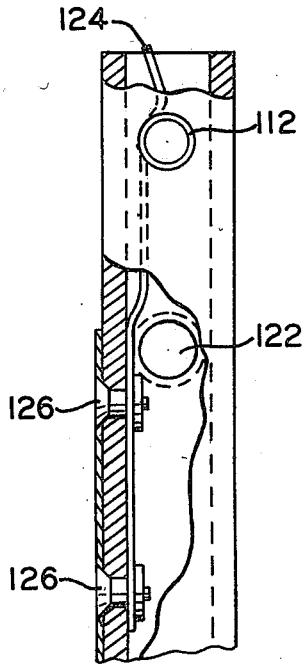
FIG. 8 is a cross-sectional view of the pin latch assembly shown in FIG. 7.

For ease of using the cargo container of the invention, the adjustable shelf 92 is provided with unique pin latches 94 which are shown in detail in FIGS. 7 and 8. Each of the latches 94 comprises a knob 110 connected to a cylindrical pin 112. The pin 112 passes through mating holes within the shelf edge extrusion 114. A second shelf edge extrusion 120, along an edge normal to that having extrusion 114 thereon, engages with the extrusion 114 by means of a shear fitting 122. Of course the extrusions 114 and 120 are appropriately fixedly secured to the appropriate edges of the shelf 92. The shelf is shown in a partial cut-away view so as to expose the balsa core 118 lying under the aluminum skin 116.

Retained within the extruded edge member 114 and secured thereto by means of fastners 126, is a metallic spring 124. The spring 124 is operative to make locking engagement with a neck 128 upon the pin 112 which creates an edge or rim at 130 against which the spring 124 may abut. In the position shown in FIG. 7, the pin 112 protrudes from the extruded member 114 and would, in this position, enter into an adjustment hole for supporting the shelf. To readjust the shelf, the operator need only lift the spring 112 and slide the pin 112 from the adjustment hole and then allow the spring 124 to re-engage the pin and frictionally hold the same within the hole of the extrusion 114 while the other pins are so removed. Once all the pins have been removed the operator may move the shelf upward or downward to the desired adjustment holes and then merely slide the pins 112 into the holes by applying pushing force to the knob 110. When the pin 112 is slid to that point where the edge or rim at 130 passes beyond the edge of the spring 124 the spring will snap down upon the neck of the pin 112 and again hold the same in the locked position. Thus the shelf is adjustable by a single operator.

It should of course be noted that the pin of FIG. 7 would be one of the two pins on the end of the shelf 92 while the pin shown in FIG. 7a is that which would be in engagement with the holes within the vertical post 74; a portion of the shelf cantilevering therefrom over into the trapezoidal end section of the cargo container. The pin assembly would, for all intents and purposes, be substantially the same as that shown in FIG. 7 but for the presence of two shear fittings 123 interconnecting the edge extrusion 120 to the pin assembly extrusion 115.

Thus it can be seen that the objects of the invention have been met by the structure presented hereinabove. While in accordance with the patent statutes only the best mode and preferred embodiment of the invention has been presented and described in detail, it is to be understood that the invention is not limited thereto or thereby. Consequently, for an appreciation of the scope and breadth of the invention reference should be had to the following claims.

What is claimed is:

1. In a cargo container having a top, a base, two end panels interconnecting said top and base, and a header extending along the edge of the top and interconnecting the two end panels, the improvement, comprising:

an upper door section supportingly engaged at the top thereof by the header and having a channel member extending along the bottom edge thereof;

a lower door section having an edge member extending along and obliquely protruding from the top thereof;

a longitudinal hinge interconnected between the channel member and edge member and extending therealong; and a shelf positioned within said container and vertically adjustable between the top and the base, the shelf having latch pin assemblies protruding therefrom, said latch pin assemblies comprising a pin slidingly received within a bore and having a recessed portion thereabout defining an edge, and a spring strip fixed at one end and flexible at the other for making engagement with the recessed portion to fixedly secure the positioning of the pin within the bore, the spring strip being flexible in a plane perpendicular to the axis of said pin, wherein the upper door section has an extended edge element along the upper edge thereof and having a U-shaped protrusion extending therefrom for making weight supporting engagement with a lip longitudinally extending along said header.

2. The improvement in a cargo container as recited in claim 1 wherein the hinge includes an upper hinge plate connected to the channel member and extending therefrom perpendicular to the upper door section and a lower hinge plate connected to the edge member and extending therefrom obliquely to the lower door section.

3. The improvement in a cargo container as recited in claim 2 wherein the upper door section is characterized by the presence of a track along each edge thereof, each track slidingly receiving a slide therein, the slide being pivotally connected to the header.

4. The improvement in a cargo container as recited in claim 1 which further includes a tension strap extending horizontally across and affixed at both ends thereof to an end panel and wherein handles are secured to said end panel at a point closely adjacent said tension strap.

5. The improvement in a cargo container as recited in claim 1 which further includes hold down straps for securing the upper and lower door sections in a stored position atop the cargo container, a first strap being connected to the upper door section and a second strap being connected to the lower door section, the first strap being engageable with a bracket affixed to the lower door section and the second strap being engageable with a bracket affixed to an end section.

* * * * *